US010986432B2

(12) United States Patent
Paetsch et al.

(10) Patent No.: US 10,986,432 B2
(45) Date of Patent: Apr. 20, 2021

(54) CUSTOMIZED EAR TIPS

(71) Applicant: Bose Corporation, Framingham, MA (US)

(72) Inventors: Christopher R. Paetsch, Cambridge, MA (US); Andrew D. Dominijanni, Newton, MA (US); John Gerard Grenier, Jamaica Plain, MA (US); Brian Fligor, Mansfield, MA (US); Daniel M. Gauger, Jr., Berlin, MA (US)

(73) Assignee: Bose Corporation, Framingham, MA (US)

( * ) Notice: Subject to any disclaimer, the term of this patent is extended or adjusted under 35 U.S.C. 154(b) by 136 days.

(21) Appl. No.: 15/640,055

(22) Filed: Jun. 30, 2017

(65) Prior Publication Data

US 2019/0007762 A1 Jan. 3, 2019

(51) Int. Cl.
*H04R 1/10* (2006.01)

(52) U.S. Cl.
CPC ..... *H04R 1/1016* (2013.01); *H04R 1/1058* (2013.01); *H04R 1/105* (2013.01); *H04R 2225/77* (2013.01); *H04R 2460/15* (2013.01)

(58) Field of Classification Search
CPC ..... H04R 1/1016; H04R 1/1058; H04R 2460/15; H04R 2225/77
See application file for complete search history.

(56) References Cited

U.S. PATENT DOCUMENTS 3,157,750 A * 11/1964 Weingartner ..... H04R 1/225 181/137
3,258,533 A * 6/1966 Bredon ..... H04B 5/06 381/151
5,412,736 A * 5/1995 Keliiliki ..... H04R 1/105 381/330
RE34,961 E * 6/1995 Widin ..... H04R 25/70 381/320

(Continued)

OTHER PUBLICATIONS

International Search Report & Written Opinion; PCT/US2018/037446; dated Sep. 13, 2018; 14 pages.

(Continued)

*Primary Examiner* — Matthew J Daniels
*Assistant Examiner* — Andrew D Graham
(74) *Attorney, Agent, or Firm* — Fish & Richardson P.C.

(57) ABSTRACT

The technology described in this document can be embodied in a method that includes receiving one or more electronic files comprising information on structural features of a portion of an ear of a user, generating an electronic representation of the eartip or a cast based on a portion of the information on the structural features of the portion of the ear, and producing the eartip based on the electronic representation. The eartip includes an outlet, and a sealing structure disposed around an exterior of the outlet, wherein a first end of the sealing structure is attached to the outlet, and a second, opposite end of the sealing structure is physically separated from the exterior of the outlet. Generating the electronic representation includes configuring one or more structural parameters of the outlet or the sealing structure in (Continued)

accordance with the structural features of the portion of the ear.

25 Claims, 11 Drawing Sheets

(56) References Cited

U.S. PATENT DOCUMENTS 6,484,842 B1 * 11/2002 Widmer ..... A61B 5/6817 181/129
8,311,253 B2 * 11/2012 Silvestri ..... H04R 1/1075 181/129
8,737,669 B2 5/2014 Monahan et al.
D712,874 S * 9/2014 Gauger, Jr. ..... H04R 1/1075 D14/206
8,900,128 B2 * 12/2014 Berglund ..... A61B 1/227 600/109
8,929,582 B2 1/2015 Silvestri et al.
8,989,426 B2 3/2015 Silvestri et al.
8,989,427 B2 * 3/2015 Silvestri ..... H04R 1/1016 381/380
9,036,852 B2 5/2015 Silvestri et al.
9,036,853 B2 5/2015 Silvestri et al.
9,042,590 B2 5/2015 Silvestri et al.
9,361,906 B2 * 6/2016 Roberts ..... H04R 25/70
9,398,364 B2 7/2016 Monahan et al.
9,462,366 B2 * 10/2016 Silvestri ..... H04R 1/1016
9,467,761 B2 * 10/2016 Grinker ..... H04R 1/1058
9,615,162 B2 * 4/2017 Huang ..... H04R 1/1091
D797,079 S * 9/2017 Houle ..... D14/223
9,774,963 B1 * 9/2017 Han ..... H04R 1/105
9,788,099 B2 * 10/2017 Mainini ..... H04R 1/105
9,792,893 B1 * 10/2017 Gauger, Jr. ..... H04R 1/1016
9,813,794 B2 * 11/2017 Cheng ..... H04R 1/02
9,924,276 B2 * 3/2018 Wenzel ..... H04R 25/456
9,955,249 B2 * 4/2018 Searl ..... H04R 1/1016
D828,826 S * 9/2018 Schaal ..... D14/223
2003/0021434 A1 * 1/2003 Hessel ..... H04R 25/70 381/312
2003/0174853 A1 * 9/2003 Howes ..... H04R 1/083 381/370
2004/0107080 A1 * 6/2004 Deichmann ..... A61F 11/08 703/6
2005/0008180 A1 * 1/2005 Smith ..... H04R 1/1016 381/328
2007/0036376 A1 * 2/2007 Fried ..... H04R 1/105 381/312
2008/0192961 A1 * 8/2008 Radivojevic ..... H04R 1/1041 381/151
2009/0323995 A1 * 12/2009 Sibbald ..... H04R 1/227 381/337
2010/0017006 A1 * 1/2010 Clausen ..... H04R 1/1016 700/98
2010/0254556 A1 * 10/2010 Warren ..... H04R 1/2842 381/328
2010/0286964 A1 * 11/2010 Boltyenkov ..... H04R 25/453 703/1
2010/0296664 A1 * 11/2010 Burgett ..... A61F 11/08 381/67
2011/0135120 A1 * 6/2011 Larsen ..... H04R 1/1016 381/151
2011/0135136 A1 * 6/2011 Kim ..... H04R 1/1016 381/380
2011/0223864 A1 * 9/2011 Wai ..... H04R 25/656 455/41.3
2011/0258839 A1 * 10/2011 Probst ..... H04R 25/652 29/594
2011/0274296 A1 * 11/2011 Wai ..... H04R 1/1016 381/121
2011/0311070 A1 * 12/2011 Epping ..... H04R 1/1016 381/74
2012/0039500 A1 * 2/2012 Silvestri ..... H04R 1/1016 381/380
2012/0057739 A1 * 3/2012 Smith ..... H04M 1/05 381/379
2012/0128192 A1 * 5/2012 Burgett ..... H04R 1/1016 381/380
2012/0242815 A1 * 9/2012 Burgett ..... H04R 1/1016 348/77
2012/0314882 A1 * 12/2012 Sibbald ..... H04R 1/1016 381/71.6
2013/0034258 A1 * 2/2013 Lin ..... A61F 11/08 381/380
2013/0216086 A1 * 8/2013 Kirkpatrick ..... H04R 1/1058 381/380
2013/0230204 A1 * 9/2013 Monahan ..... H04R 1/1016 381/380
2013/0315411 A1 * 11/2013 Annunziato ..... G10K 11/16 381/71.6
2013/0315431 A1 * 11/2013 Grinker ..... H04R 1/1016 381/380
2014/0072140 A1 * 3/2014 Hankey ..... G06F 17/50 381/74
2014/0126734 A1 * 5/2014 Gauger, Jr. ..... H04R 3/002 381/71.6
2014/0126736 A1 * 5/2014 Gauger, Jr. ..... G10K 11/178 381/71.6
2015/0030196 A1 * 1/2015 Basseas ..... H04R 1/1016 381/380
2015/0139474 A1 * 5/2015 Henry ..... H04R 1/1016 381/380
2015/0146909 A1 * 5/2015 Kirkpatrick ..... H04R 25/652 381/380
2015/0264467 A1 * 9/2015 Annunziato ..... H04R 1/1058 381/380
2015/0382123 A1 * 12/2015 Jobani ..... H04R 1/1016 700/98
2016/0073192 A1 * 3/2016 Briggs ..... H04R 1/1058 381/380
2016/0241946 A1 8/2016 Monahan et al.
2017/0104977 A1 * 4/2017 Fei ..... B33Y 30/00
2017/0111731 A1 * 4/2017 Merks-Swolfs ..... H04R 1/2807
2017/0200444 A1 * 7/2017 O'Connell ..... G10K 11/17881
2017/0208382 A1 * 7/2017 Grinker ..... G10K 11/17881
2017/0223443 A1 * 8/2017 Silvestri ..... H04R 1/1016
2017/0257694 A1 * 9/2017 Boesen ..... B33Y 50/00
2017/0305040 A1 * 10/2017 Schreiner ..... B29C 45/0055
2018/0005622 A1 * 1/2018 Kyllonen ..... H04R 1/1016
2018/0020281 A1 * 1/2018 Wurtz ..... G10K 11/178
2018/0041828 A1 * 2/2018 Sibbald ..... G10K 11/178
2018/0109861 A1 * 4/2018 Prevoir ..... C08K 5/01
2018/0160216 A1 * 6/2018 Dominijanni ..... H04R 1/1066
2019/0007762 A1 * 1/2019 Paetsch ..... H04R 1/1016

OTHER PUBLICATIONS

U.S. Appl. No. 14/553,350, filed Nov. 25, 2014, Silvestri et al.
U.S. Appl. No. 14/851,169, filed Sep. 11, 2015, Silvestri et al.
U.S. Appl. No. 15/137,632, filed Apr. 25, 2016, Monahan et al.
U.S. Appl. No. 15/293,379, filed Oct. 14, 2016, Silvestri et al.
Lantos Technologies; Uvero; [retrieved on Sep. 28, 2017]; Retrieved from the Internet: URL http://uvero.com/home/; 4 pages.
Ulti Mate Ears; [retrieved on Sep. 28, 2017]; Retrieved from Internet: URL http://pro.ultimateears.com/products/custom-monitors# ; 5 pages.
Jerry Harvey Audio LLC; [retrieved on Sep. 28, 2017]; Retrieved from Internet: URL http://pro.ultimateears.com/products/custom-monitors# ; 6 pages.
Sensaphonics Hearing Wellness; [retrieved on Sep. 28, 2017]; Retrieved from Internet: URL http://www.sensaphonics.com/ ; 1 page.
64 Audio—In-Ear Monitors; [retrieved on Sep. 28, 2017]; Retrieved from Internet: URL http://www.sensaphonics.com/ ; 1 page.
Revols Custom-Fit Wireless Earphones; [retrieved on Sep. 28, 2017]; Retrieved from Internet: URL https://www.revols.com/ ; 6 pages.
Decibullz Custom Molded Audio and Hearing Protection; [retrieved on Sep. 28, 2017]; Retrieved from Internet: URL https://www.decibullz.com/; 7 pages.

(56) References Cited

OTHER PUBLICATIONS

Outside on Line—Normal Earbuds; [retrieved on Sep. 28, 2017]; Retrieved from Internet: URL https://www.outsideonline.com/2001276/normal-earbuds ; 10 pages.
Bragi—Custom Earphones; The Dash Pro; [retrieved on Sep. 28, 2017]; Retrieved from Internet: URL https://www.bragi.com/thedashpro/customize ; 19 pages.
Snugs Earphones; [retrieved on Sep. 28, 2017]; Retrieved from Internet URL: https://www.bragi.com/thedashpro/customize ; 7 pages.
Oticon.com; [retrieved on Oct. 17, 2017]; Retrieved from Internet URL: https://www.oticon.com/; 7 pages.
Phonak—life is on; [retrieved on Oct. 17, 2017]; Retrieved from Internet URL: https://www.phonak.com/us/en.html ; 9 pages.
Starkey Hearing Technologies; [retrieved on Oct. 17, 2017]; Retrieved from Internet URL: http://www.starkey.com/ ; 7 pages.
ReSound$^{GN}$; [retrieved on Oct. 17, 2017]; Retrieved from Internet URL: http://www.resound.com/en-US ; 3 pages.
Widex; [retrieved on Oct. 17, 2017]; Retrieved from Internet URL: https://www.widex.com/en-us ; 3 pages.
Sivantos—The Hearing Company; [retrieved on Oct. 17, 2017]; Retrieved from Internet URL: https://www.sivantos.com/en/about-us/our-brands/ ; 5 pages.

* cited by examiner

CUSTOMIZED EAR TIPS

TECHNICAL FIELD

This disclosure generally relates to eartips used in earpieces associated with acoustic devices.

BACKGROUND

Acoustic earpieces can be placed within human ears, e.g., as part of earphones, Bluetooth devices, etc., to deliver sound to the ears. Eartips are often used as an interface between an acoustic earpiece and the ear canal of the user.

SUMMARY

In one aspect, this document features a method of producing an eartip. The method includes receiving one or more electronic files comprising information on structural features of a portion of an ear of a user, generating, by one or more processing devices, an electronic representation of the eartip or a cast of the eartip based on at least a portion of the information on the structural features of the portion of the ear, and producing the eartip based on the electronic representation. The eartip includes (i) an outlet, and (ii) a sealing structure disposed around an exterior of the outlet, wherein a first end of the sealing structure is attached to the outlet, and a second, opposite end of the sealing structure is physically separated from the exterior of the outlet. Generating the electronic representation includes configuring one or more structural parameters of the outlet or the sealing structure in accordance with the structural features of the portion of the ear (e.g., the ear canal).

In another aspect, this document features one or more non-transitory machine-readable storage devices having encoded thereon computer readable instructions for causing one or more processing devices to perform various operations. The operations include receiving one or more electronic files comprising information on structural features of a portion of an ear of a user, generating an electronic representation of the eartip or a cast of the eartip based on at least a portion of the information on the structural features of the portion of the ear, and producing the eartip based on the electronic representation. The eartip includes (i) an outlet, and (ii) a sealing structure disposed around an exterior of the outlet, wherein a first end of the sealing structure is attached to the outlet, and a second, opposite end of the sealing structure is physically separated from the exterior of the outlet. Generating the electronic representation includes configuring one or more structural parameters of the outlet or the sealing structure in accordance with the structural features of the portion of the ear (e.g., the ear canal).

In another aspect, this document features an eartip that includes a body that includes a receptacle for receiving a connection to an acoustic device, an outlet having a first end connected to the body, and a second distal end configured to radiate acoustic energy out of the eartip, and a sealing structure disposed around an exterior of the outlet. A first end of the sealing structure is attached to the distal end of the outlet, and a second, opposite end of the sealing structure is physically separated from the exterior of the outlet. The second end of the sealing structure is closer to the body than the first end of the sealing structure. One or more structural parameters of the outlet or the sealing structure are configured in accordance with the structural features of the ear canal of a user, the one or more structural parameters including at least one of a length and curvature of the outlet.

A first portion of the sealing structure is undersized with respect to a corresponding first portion of the ear canal, and a second portion of the sealing structure is oversized with respect to a corresponding second portion of the ear canal.

Implementations of the above aspects can include one or more of the following features. Configuring the one or more structural parameters can include configuring a thickness of at least a portion of the sealing structure, the thickness being a distance between an interior surface and an exterior surface of the sealing structure. Configuring the one or more structural parameters can include configuring a thickness of at least a portion of the outlet, the thickness being a distance between an interior surface and an exterior surface of the outlet. Configuring the one or more structural parameters can include configuring a length and curvature of the outlet in accordance with the structural features of the portion of the ear. Configuring the one or more structural parameters can include configuring an orientation of the sealing structure in accordance with the structural features of the portion of the ear.

The eartip can include (i) a body connected to one end of the outlet, and (ii) a retaining structure connected to the body, such that when the eartip is worn by the user, the body fits in at least a part of the concha of the user's ear, and the retaining structure applies pressure to the antihelix of the user's ear. The one or more electronic files can include information on structural features of an antihelix of a user, and configuring the one or more structural parameters can include configuring a location at which the retaining structure is connected to the body. Configuring the one or more structural parameters can include configuring a location at which the outlet is connected to the body. The retaining structure may be configured in accordance with structural features of the pinna of the user's ear.

The one or more electronic files can be generated, at least in part, based on output of a scanning device configured to scan the portion of the ear of the user. The one or more electronic files can be generated, at least in part, based on a mold of the portion of the ear of the user. The electronic representation of the eartip can include a first portion of the sealing structure that is undersized with respect to a corresponding first portion of an ear canal, and a second portion of the sealing structure that is oversized with respect to a corresponding second portion of the ear canal.

The location of at least one of the first portion and the second portion of the sealing structure with respect to the structural features of the ear canal may be determined responsive to receiving user-input indicative of an eartip-type. The location of a distal end of the outlet with respect to the structural features of the portion of the ear may be determined responsive to receiving user-input indicative of an eartip-type, Producing the eartip based on the electronic representation can include producing a cast based on the electronic representation, and producing the eartip using the cast. The one or more structural parameters can include the length of the outlet and cross sectional area of at least a portion of the outlet, and at least one of the length and the cross sectional area can be configured based on target acoustic characteristics of the eartip. The target acoustic characteristics can include an acoustic mass below 900 $Kg/m^4$.

Various implementations described herein may provide one or more of the following advantages. Eartips can be customized to accommodate diverse ear geometries, making the eartips available even to users who cannot comfortably use standard eartips. Different types of eartips can be produced in accordance with user preferences regarding comfort, fit, and style. By allowing eartips to be configured in accordance with structural features of a particular user's ear, deformation and wear-and-tear of the eartips may be reduced, thereby potentially increasing the life of the eartips. Electronically storing the representations of the custom eartips also allows for producing additional eartips on demand, potentially without subjecting the user to repeated measurement processes.

Two or more of the features described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

DETAILED DESCRIPTION

This document describes customized eartips that are configured in accordance with structural features of the ear, including ear canals, of particular users. A customized eartip can include an outlet or nozzle and a sealing structure (which may also be referred to as the "umbrella"), which are configured to fit into the concha and/or ear canal. The eartip may also include a body, which may be connected to a retaining structure that is configured to hold the eartip in place using the concha and the anti-helix of the user as support. Because of variations in ear geometry, in some instances, non-customized eartips may be uncomfortable, loose, and/or even unusable for some users, particularly ones who have larger-than-usual, or smaller-than-usual structural features of the ear. For example, a user having an ear canal with a large cross-section may need to push an eartip deep into the canal for stability. However, even this may be loose, and/or cause discomfort for the particular user. On the other hand, a user having an ear canal with a small cross-section may find the same eartip to be too tight, and feel discomfort during the use of the eartip. The present disclosure describes technology for customizing various portions of an eartip based on structural features of the ear of a corresponding user and/or one or more preferences of the user with respect to comfort and stability. For example, eartips can be customized in accordance with structural features of the user's ear canal and/or pinna, as well as in accordance with a trade-off between comfort and stability as perceived by the user. In some cases, such personalized eartips can result in significant improvements in comfort level and overall user-experience associated with using the eartips. The technology described herein can therefore make eartips available to a wide range of users, including those who cannot comfortably use one-size-fits-all or one-size-fits-most eartips due to having ear features that are incompatible with such eartips. In some cases, the technology described herein may also improve audio and noise reduction performance, potentially due to improved effective acoustic seal of the custom eartips.

Figure 1:
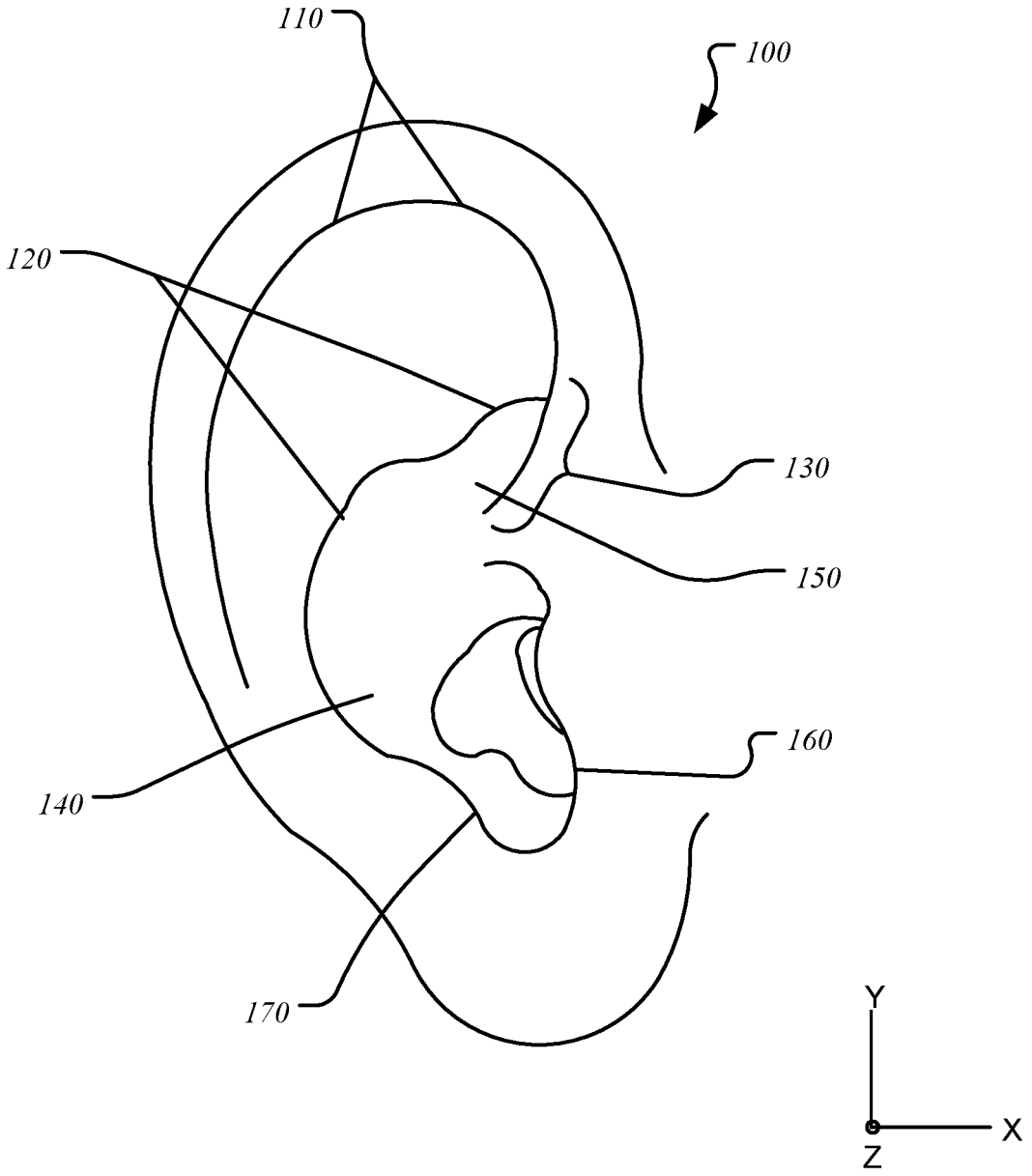
FIG. 1 is an exterior view of a human ear.

FIG. 1 shows an exterior view of a human right ear 100, with features of the ear identified. For example, FIG. 1 shows the helix 110, anti-helix 120, base-of-the-helix 130, concha 140, cymba-concha 150, tragus 160, and anti-tragus 170. However, different ears have different sizes and geometries. In this regard, the precise structure of the human ear varies from individual to individual. For example, some ears have additional features that are not shown in FIG. 1, and some ears may lack some of the features that are shown in FIG. 1. Likewise, some features of different ears may be more or less prominent than those shown in FIG. 1.

Figure 2:
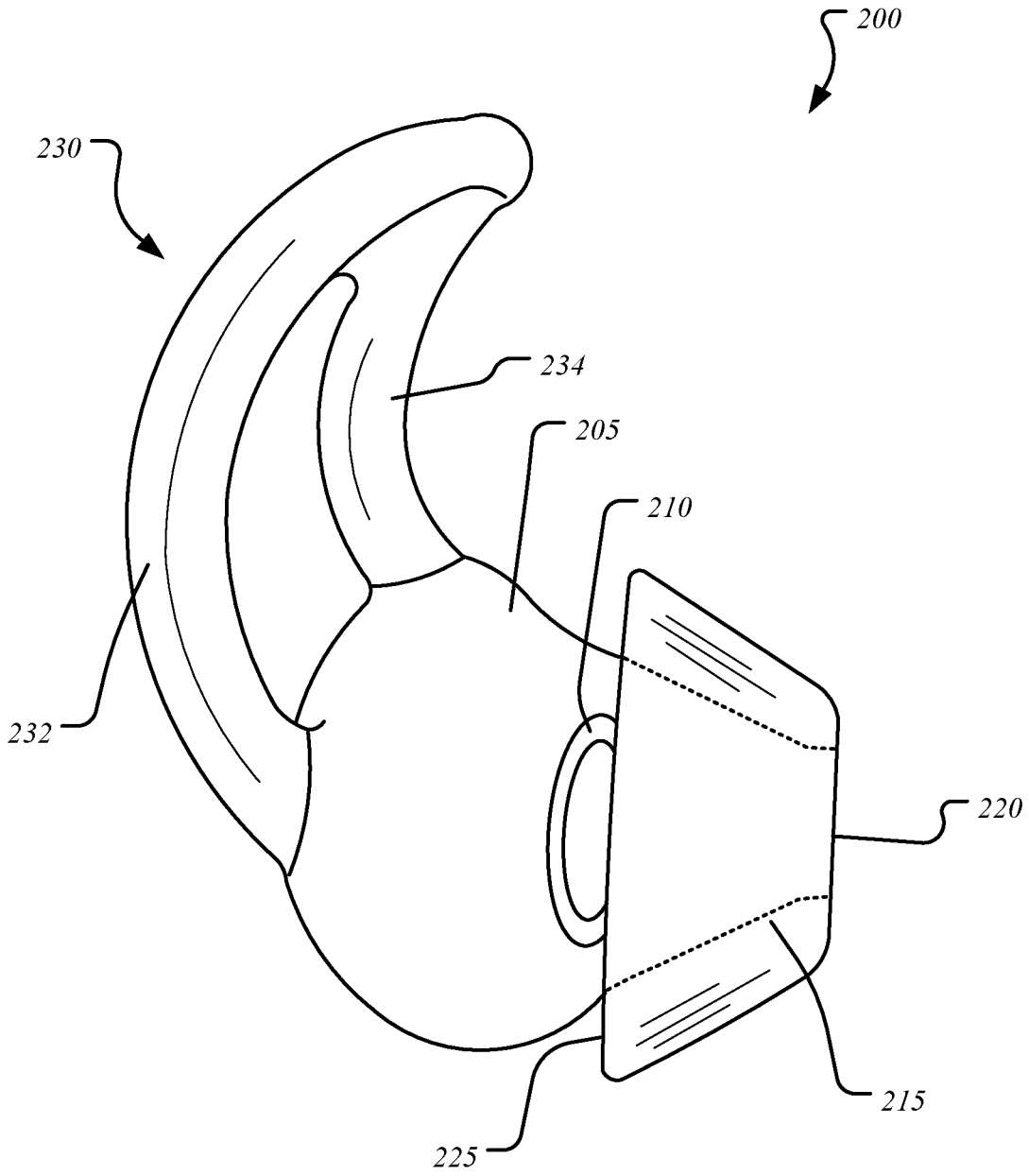
FIG. 2 is a side-view of an example of an eartip with a retaining structure and sealing structure.

FIG. 2 shows an example of an eartip 200 that can be connected to an audio generating device. For example, the eartip 200 can be coupled to an earpiece or acoustic driver associated with the audio generation device. In some implementations, the eartip 200 may lack any connections and function as a passive earplug. The eartip 200 can include a body 205 that can be coupled to an acoustic driver or speaker. For example, the body 205 can include a receptacle for receiving a snap-fit connection to an acoustic driver. In some examples, the body 205 may be coupled to a housing in which an acoustic driver or speaker resides. The body 205 can be connected to an acoustic passage or outlet 210 (also referred to as a nozzle) that conducts sound waves from the body 205 to an ear canal of a user. For example, one end of the outlet 210 can be connected to the body 205, while, a second, distal end is configured to radiate acoustic energy out of the eartip 200 and towards an ear canal of a user. The outlet 210 and body 205 may be integrally formed, or may be separate pieces.

In some implementations, the outlet 210 can be covered, at least partially, by a sealing structure 215, which is configured to form a sealing fit with the ear canal of the user. In some cases, such a sealing fit reduces external noise entering the ear canal, thereby providing passive noise attenuation. In some implementations, the sealing structure 215 is disposed around an exterior of the outlet 210 such that a first end 220 of the sealing structure is attached to the distal end of the outlet 210, and a second, opposite end 225 of the sealing structure 215 is physically separated from the exterior of the outlet. As shown in FIG. 2, the second end 225 of the sealing structure is closer to the body 205 as compared to the first end 220 of the sealing structure 215. The appearance of the sealing structure 215 can resemble that of a hollow truncated cone having an exterior surface (visible in FIG. 2), and an opposite interior surface facing the outlet. In some implementations, such a frusto-conical structure may have an elliptical or oval cross section, with a wall that tapers substantially linearly. The walls of the sealing structure 215 may be slightly rounded when viewed from the side, as in FIG. 2. In some implementations, the sealing structure 215 can be constructed of materials including silicones, TPUs (thermoplastic polyurethanes) and TPEs (thermoplastic elastomers), or other combination of materials. Examples of materials that may be used include viscoelastic materials such as ones described in U.S. application Ser. No. 15/370,516 ("Earpieces Employing Viscoelastic Materials"), filed on Dec. 15, 2016, the entire content of which is incorporated herein by reference. The separation between the exterior and interior surfaces at a given portion of the sealing structure 215 is referred to as the thickness of the sealing structure. Due to the shape of the sealing structure 215, it may be referred to as an "umbrella." Under that analogy, the thickness of the sealing structure (or the wall of the sealing structure 215) would be analogous to the thickness of the fabric of an umbrella. The air gap between the inside surface of the sealing structure 215 and the exterior of the outlet 210 provides additional compliance for the sealing structure 215.

In some implementations, the body 205 is coupled to a retaining structure 230 that engages with external structural features of the user's pinna to provide mechanical stability for holding the eartip 200 in place. For example, the retaining structure 230 can be configured to engage with at least a portion of the antihelix of the user's ear, to support the body (which is configured to sit in at least a part of the concha) and hold the eartip 200 in place in the ear canal. The retaining structure 230 can have various shapes and sizes. In the example shown in FIG. 2, the retaining structure 230 includes an outer portion 232 and an inner portion 234. In such cases, the outer portion 232 is shaped to generally follow the curve of the anti-helix and/or the cymba concha at the rear of the concha. The outer portion 232 and the inner portion 234 can lie on one plane and can be connected to one another at least at one end. In some examples, the inner portion 234 may be omitted and only a single leg be used to retain the eartip 200 in place. The body 205 and retaining structure 230 may be integrally formed, or may be separate pieces.

In some implementations, one or more of the body 205, the retaining structure 230, and the sealing structure 215 may be made of, for example, a soft silicone rubber having a prerequisite hardness (e.g., 30 Shore A or less). The walls of the sealing structure 215 can be of a uniform thickness, which may be, for example, less than one millimeter. The walls of the sealing structure 230 can be configured to taper to the base of the frusto-conical structure so that the walls deflect to provide a good seal and good passive attenuation without exerting significant radial pressure on the ear canal.

While the eartip 200 shown in FIG. 2 is configured to generally fit various types of ear geometries, it is not customized for individual users. In some cases however, the one-size-fits-all or one-size-fits-most approach may not be appropriate for certain users. For example, if a particular user has ear features that are substantially different from those the eartip 200 is designed for, the user may find the eartip 200 uncomfortable or unstable, at least for use over extended periods. For example, the sealing structure 215 of the eartip 200 may not adequately contact the periphery of an ear canal that has a large cross-section, thereby rendering the fit too loose for comfortable use. Conversely, the seal may be too tight for users with smaller than usual ear canals, resulting in an uncomfortable fit.

The technology described herein allows for customizing or personalizing various structural features of an eartip for a user such that the eartip conforms to particular structural features of the user's ear. For example, the shape and size of an outlet and/or sealing structure of an eartip may be customized in accordance with the structural features of the ear canal of the particular user. In some cases, the shape and structure of a retaining structure and a body of the eartip, as well as the locations at which the retaining structure is connected to the body may also be customized in accordance with structural features of the user's ear. For example, the retaining structure and the body, as well as their relative positions can be configured such that the body seats in the concha and the retaining structure seats under the antihelix.

Figure 3:
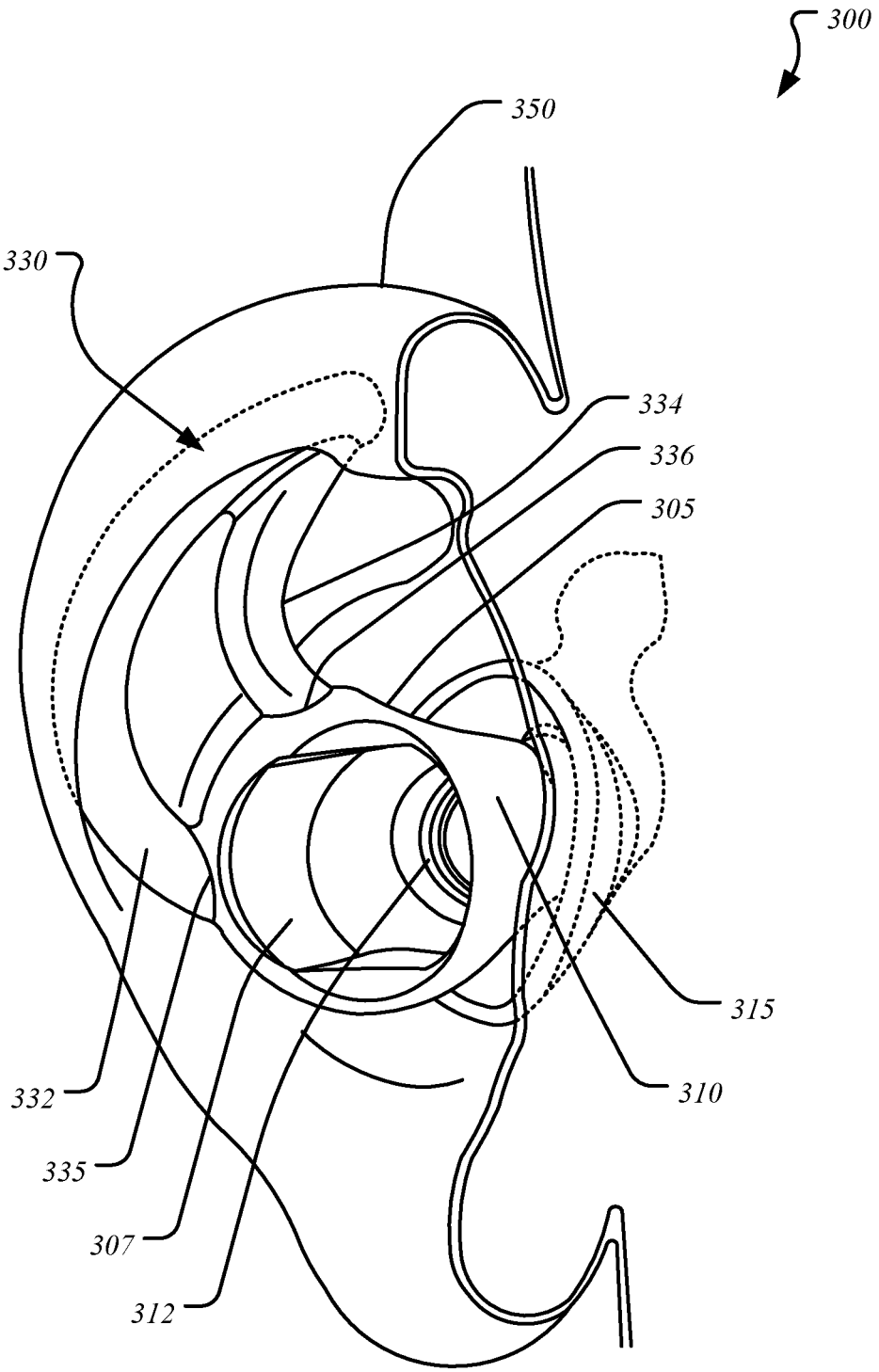
FIG. 3 is an example of a custom-fit eartip.

FIG. 3 shows an example of a customized eartip 300. For the eartip 300, the outlet 310 and the sealing structure 315 are configured in accordance with structural features of a user's ear 350. The example of FIG. 3 also shows the interior surface 307 of the body 305, and the interior surface 312 of the outlet 310. The opening in the body 305 through which the interior surfaces are visible can be configured to accept an acoustic transducer or driver, or a housing thereof, in a removable configuration. In some implementations, the locations 335 and 336, at which the outer portion 332 and inner portion 334, respectively, of the retaining structure 330 are connected to the body, can also be configured in accordance with structural features of the user's ear 350.

Figure 4A:
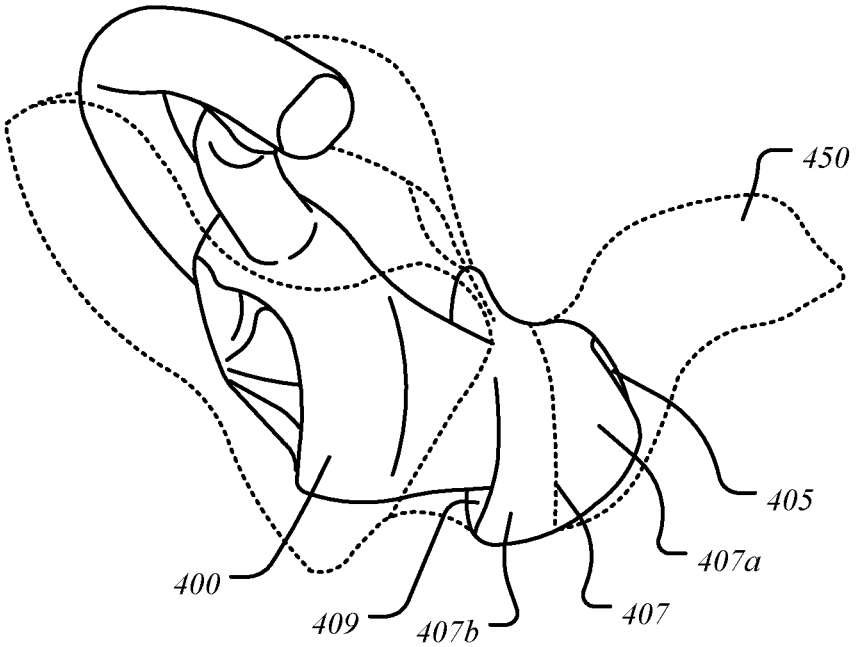
FIGS. 4A and 4B are examples of two different variants of custom-fit eartips.

In some cases, the customized eartip can be designed in accordance with a user's preferences regarding comfort and/or stability. For example, FIG. 4A shows a "stability" variant 400 of an eartip, in which the distal end 405 of the outlet is configured to sit deeper inside a user's ear canal 450 (relative to a "comfort" variant) in accordance with the user's preference for increased stability. Conversely, if the user does not want the distal end of the outlet to sit too deep into the ear canal, a different, "comfort" variant can be designed accordingly.

Figure 4B:
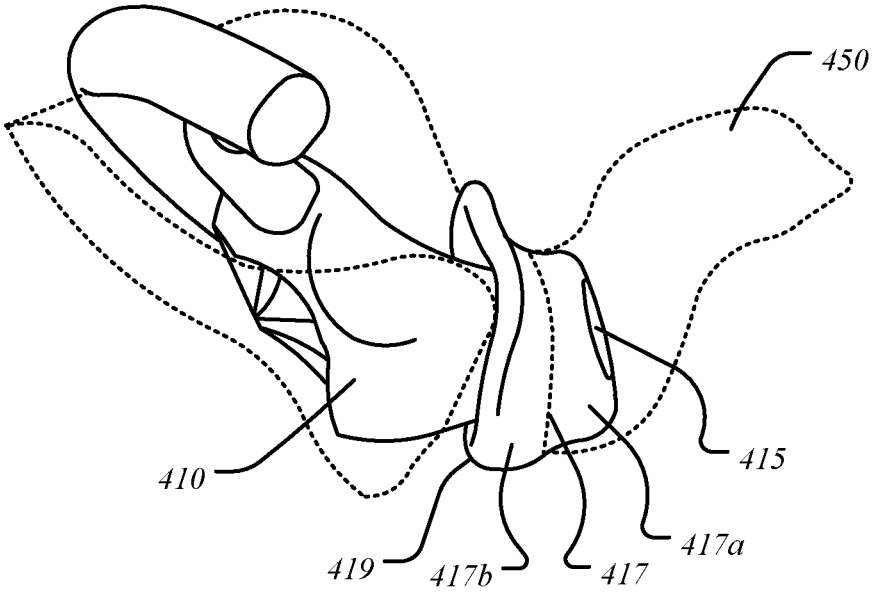

FIG. 4B shows an example of such a variant 410, in which the distal end 415 of the outlet is configured to sit closer to the external opening of the ear canal 450, as compared to that in the stability variant shown in FIG. 4A. The shape of the sealing structure 407 in the variant 400 can be configured to be different from the shape of the sealing structure 417 in the variant 410, in order to accommodate the differences between the two eartips. In some implementations, the technology described herein allows a user to configure multiple variants of eartips, which may be used for different purposes. For example, a user may obtain a "comfort" variant for regular use, and a "stability" variant for use during workouts or other physically intense activities.

In some implementations, the distal end 405 of the outlet in the variant 400 sits in the first half of the first bend of the ear canal 450, and the body end 409 of the sealing structure 407 terminates a few millimeters (e.g., 1-2 mm) inside the ear canal aperture. In some implementations, the sealing structure 407 may terminate outside the ear canal aperture. In some implementations, the depth of insertion is achieved using a combination of a first portion of the sealing structure that is undersized with respect to a corresponding first portion of the ear canal (i.e., sized smaller than the corresponding portion of the ear canal), and a second portion of the sealing structure that is oversized with respect to a corresponding second portion of the ear canal (i.e., sized larger than the corresponding portion of the ear canal). In some implementations, the transition region between the undersized (407*a*) and oversized (407*b*) portions of the sealing structure can be configured, for example, using a parameter that sets the length of the transition region based on a selected cross-section. For example, the transition region between the portions 407*a* and 407*b* may be determined based on a location of the user's ear canal that provides good seal/good acoustic performance. Specifically, if the typical transition region coincides with a portion of unusual curvature for a particular user, the quality of the seal may be compromised. In such a case, the location of the transition region can be customized to avoid the portion of unusual curvature.

In some implementations, the transition region may be centered approximately at the midpoint of the sealing structure. In the example of FIG. 4A, the distal portion 407*a* of the sealing structure 407 is undersized to enable the sealing structure 407 to sit deeper in the ear canal 450 (when compared to the example of FIG. 4B). The body end portion 407*b* of the sealing structure is oversized with respect to the corresponding portion of the ear canal in order to provide a seal along a substantially continuous path at the interface between the sealing structure 407 and the ear canal 450. In some implementations, the oversized portion may prevent the sealing structure from being inserted into the ear canal beyond a certain point or allow for a seal if it is not inserted deep enough into the ear canal. In some implementations of the variant 400, the body end portion 407*b* of the sealing structure 407 is oversized by about ¾ mm and the distal portion 407*a* is undersized by about 1 mm. In some implementations, the overall length of the sealing structure 407 is 5 mm or more.

As shown in the example of FIG. 4B, the distal end 415 of the outlet of the "comfort" variant 410 does not sit as deep in the ear canal as the distal end of the "stability" variant 400. Correspondingly, in some implementations of the variant 410, the distal portion 417*a* of the sealing structure 417 does not extend into the first bend of the ear canal, which generally makes the sealing structure 417 appear to be relatively less curved as compared to the sealing structure 407 in the "stability" variant 400. In some implementations, the variant 410 can be configured such that at least a portion of the body end 419 of the sealing structure 417 terminates closer to the external opening of the ear canal aperture as compared to a corresponding portion in the variant 400. In some implementations, the sealing structure 417 sits behind the tragus in the relatively straight portion of the ear canal 450 before the first bend. This depth of insertion can be achieved, for example, by oversizing the body end portion 417*b* of the sealing structure 417, such that the oversized portion contacts a corresponding portion of the ear that is farther out in the ear canal as compared to the portion contacted by the body end portion 407*b* in the variant 400. In some examples, the undersized distal portion in the variant 410 extends over a smaller portion of the sealing structure 410 as compared to that in the variant 400. Therefore, in some implementations, the length of the sealing structure 417 of the "comfort" variant is shorter than the length of the sealing structure 407 of the "stability" variant.

The sealing structure and/or outlet of a customized eartip can have a uniform or non-uniform thickness. In some implementations, a non-uniform thickness of the sealing structure and/or the outlet may improve comfort and/or acoustic seal for the corresponding eartip. In some implementations, the thickness, whether uniform or non-uniform, may be customized for different users. For example, the thickness of the outlet and/or sealing structure for a user having larger ear canals can be larger than that for another user with smaller ear canals. In some implementations, increasing the thickness of the distal end of the sealing structure and/or the outlet may help to prevent inversion of the sealing structure during removal from the user's ear, thereby potentially improving durability of the eartips. In some implementations, the customized eartips can be constructed from soft silicone, e.g., silicone having Shore A hardness in the range of 15-40. In some implementations, the hardness of the silicone may be adjusted to improve comfort/fit, potentially in conjunction with adjustments to the thickness of the sealing structure and/or the outlet, in accordance with target mechanical characteristics of the eartips.

Customized eartips such as the ones shown in FIGS. 4A and 4B can be created based on information on the structural parameters of the user's ears. Such information can be obtained, for example, from a scan of a user's concha and ear canal. The information may also be obtained from a custom mold of the concha and ear canal prepared for the particular user. For example, the custom mold can be scanned in order to obtain information about the structural features relevant to the customization. In some implementations, the scan results can be stored in the form of one or more electronic files, which can then be used to obtain the information on structural features of the user's ear. The one or more electronic files can include one or more three dimensional (3D) mesh representations of the user's ear canal and/or pinna, information from which can be used to compute a position of the body and retaining structure in the user's ear. In some implementations, the one or more electronic files can be based on, at least in part, output of a scanning device configured to scan the ear canal of the user. An example of a scanning device that may be used is described in U.S. Pat. Nos. 8,107,086, and 8,112,146, the entire contents of which are incorporated herein by reference.

At least a portion of the information on the structural features of the user's ear included in the one or more electronic files can be used to generate an electronic representation of the eartip (or a cast for the eartip). In some implementations, the outlet and/or the sealing structure may be customized during the generation of such an electronic representation in accordance with the corresponding structural features of the user's ear. For example, a length, curvature, and/or a thickness of at least a portion of the outlet may be customized in accordance with corresponding structural features of the ear canal. For example, an outlet for a user with a large concha can be configured to be longer than the outlet for a user with a smaller concha. In another example, an orientation and/or a thickness of at least a portion of the sealing structure may be configured in the electronic representation in accordance with the structural features of the ear canal. In some implementations, at least one of the length and the cross sectional area of the outlet can be configured based on target acoustic characteristics of the eartip. For example, the parameters may be configured based on a specified acoustic mass, which can represent the resistance of the air mass inside a given volume, such as that of the outlet. In some implementations, where the length of the outlet is determined by the ear geometry, a cross sectional area of the outlet can be adjusted (e.g., made larger to decrease the acoustic mass, and vice versa) to configure an eartip based on structural characteristics of the ear as well as target acoustic characteristics. In some implementations, the location of the distal ends 405, 415 of the respective variants in the ear canal can be configured in accordance with desired acoustic performance.

Various other structural parameters of the eartip may also be customized during the generation of the electronic representation of the eartip or the cast of the eartip. Examples of such structural parameters include shape and size of the retaining structure, shape and size of the body, location at which the outlet is connected to the body, and/or location(s) at which the retaining structure is connected to the body. In some implementations, customizing various structural features of the eartip can configure the eartip for custom placement within user's ear. For example, the sealing structure of the eartip may be custom shaped, and the retaining structure can be configured for custom placement at appropriate locations in a wearer's ear (e.g., within the concha and underneath the antihelix, respectively).

Once the electronic representation of the eartip or the cast of the eartip is generated, the actual eartip can be produced based on the electronic representation. In some implementations, this can include first producing a cast based on the electronic representation, and then producing the eartip by filling the cast with the material of the eartip. In some implementations, the eartip may be produced directly from the electronic representation, for example, by 3D printing the eartip based on the electronic representation. In some implementations, a combination of different techniques could be used where a portion of the eartip is produced from a cast, and a different portion is 3D printed. In some implementations, a customized sealing structure may be produced using a dynamic tool that shapes an initial generic membrane or structure (e.g., using compressed air applied from behind to force the generic structure against a custom model) to generate a customized sealing structure. In some implementations, the custom model itself may be 3D printed.

Figure 5A:
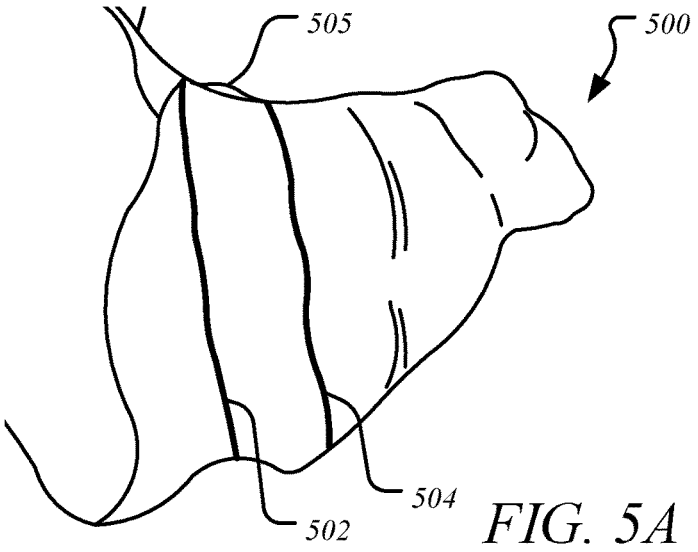
FIGS. 5A-5H illustrate electronic representations that show various stages of development of a custom-eartip.

Generating the electronic representation of the eartip or the cast of the eartip, and customizing the representation, includes several steps. FIGS. 5A-5H show the various stages associated with generating the electronic representation of the eartip or cast. FIG. 5A shows a 3D representation 500 of an example ear canal that may be used as the starting point of the customizations. The 3D representation 500 may be obtained based on the one or more electronic files described above. In some implementations, the 3D representation 500 may be preprocessed, for example, to increase or decrease the overall size of a scan to improve retention, seal, and/or comfort. In some cases, any deformities in the scan may be removed at the preprocessing stage. Examples of deformities include wrinkles, holes, dimples, or other artifacts that are deemed irrelevant for generating the electronic representation of the eartip or cast.

Figure 5B:
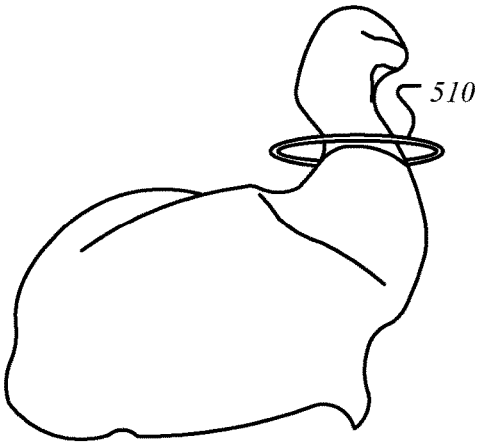
Figure 5C:
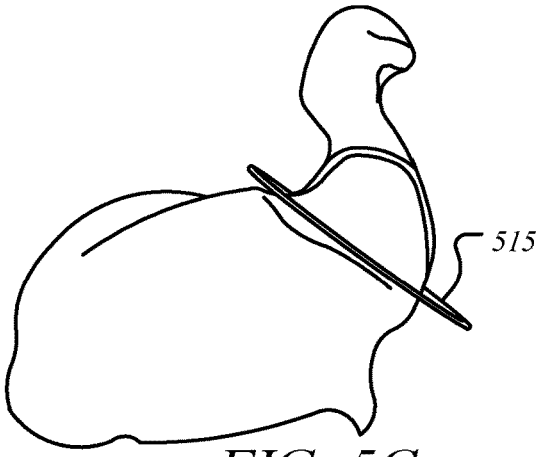

In some implementations, one or more regions in the representation 500 are processed to affect the properties of the custom eartip, for example, to increase comfort, add retention properties, or improve seal. In the example of FIG. 5A, the region between the lines 502 and 504 is processed to add a ridge or bulge 505 in accordance with desired specifications of the target eartip. The tip of the cast or the eartip can then be created, as shown in the examples of FIGS. 5B and 5C. Specifically, in the example of FIG. 5B, the plane 510 is used to define the distal end of the eartip, and to smooth the edges of the cast. In some implementations, a taper may be applied to the distal end of the cast, for example, to reduce discomfort due to the resulting eartip touching the ear canal walls and/or to configure the shape of the final product in order to make it easier to insert. In some implementations, the plane 510 is oriented perpendicular to the normal direction of the canal at the location of the plane 510. In some implementations, a second plane 515 is used to define the location of the body end of the sealing structure 517. The second plane 515 may also be oriented perpendicular to the normal direction of the canal at the location at which it is placed.

Figure 5D:
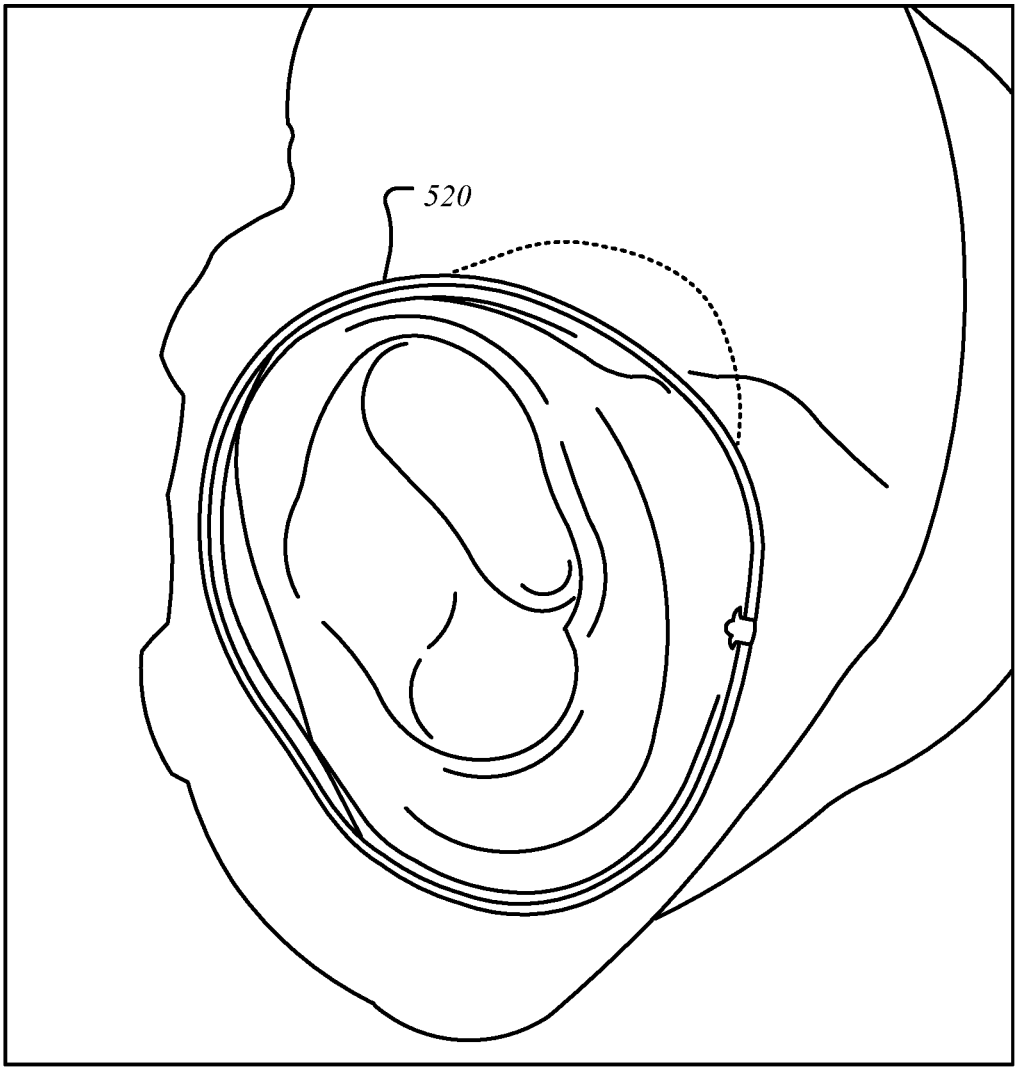
Figure 5E:
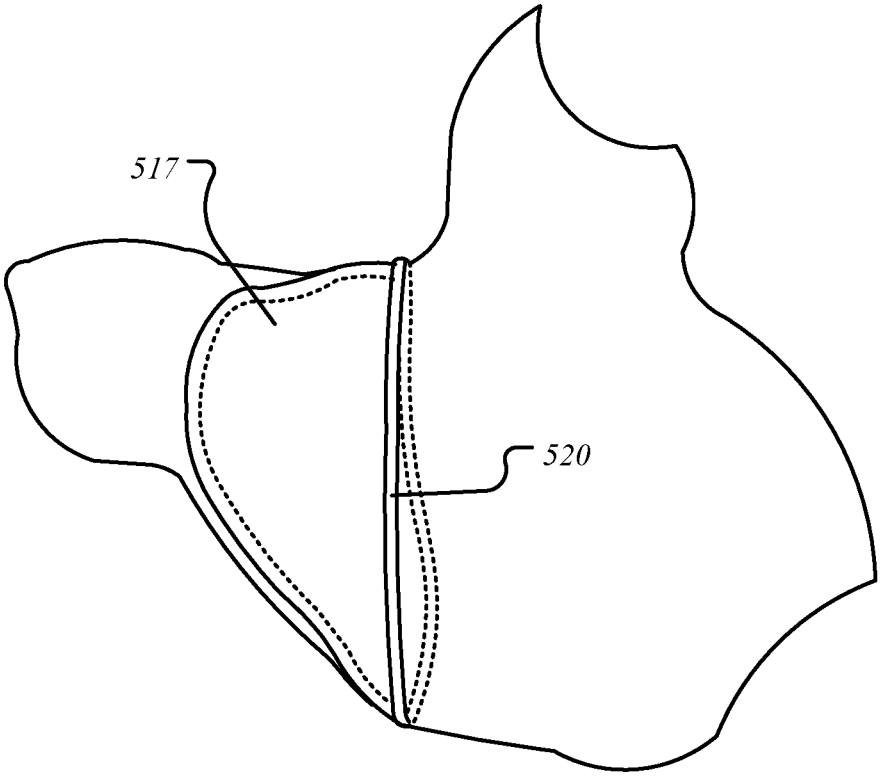

Referring now to FIGS. 5D and 5E, a spline 520 is positioned to define the body end of the sealing structure 517. In some implementations, the spline 520 is positioned behind the tragus, across the bottom of the aperture just inside the inter-tragal notch, slightly into the concha, and up and over just outside the aperture. In some implementations, the spline 520 follows the outside of the ridge 505 as shown in FIG. 5A. The shape and position of the spline 520 can depend on the structural characteristics of the ear canal of the particular user. For example, the spline 520 has a more rounded shape for a rounder canal and/or concha. In another example, an ear with a wide, tall, or narrow concha may require the spline to 520 to be placed at various locations within the concha for a desired fit.

Figure 5F:
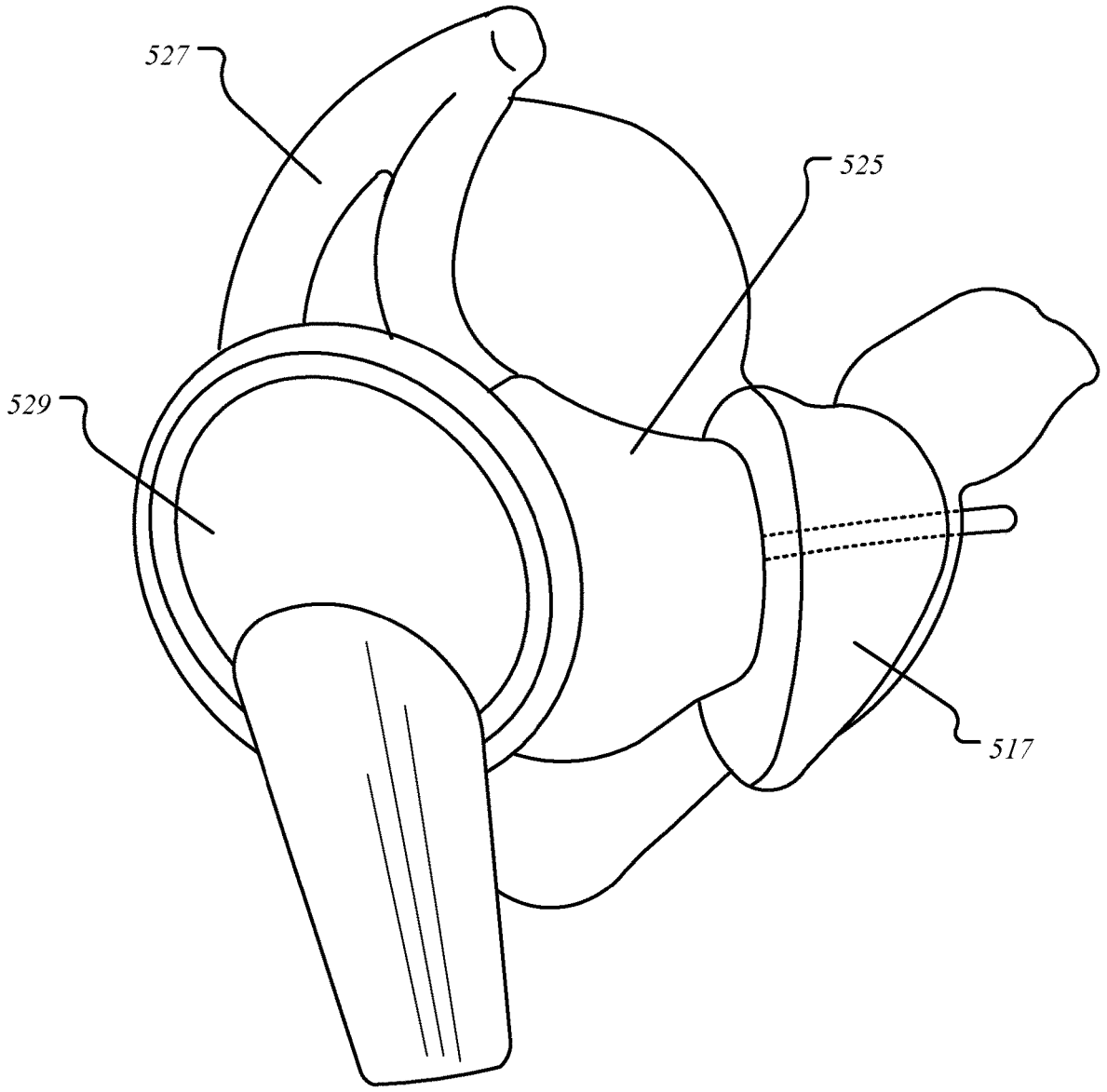
Figure 5G:
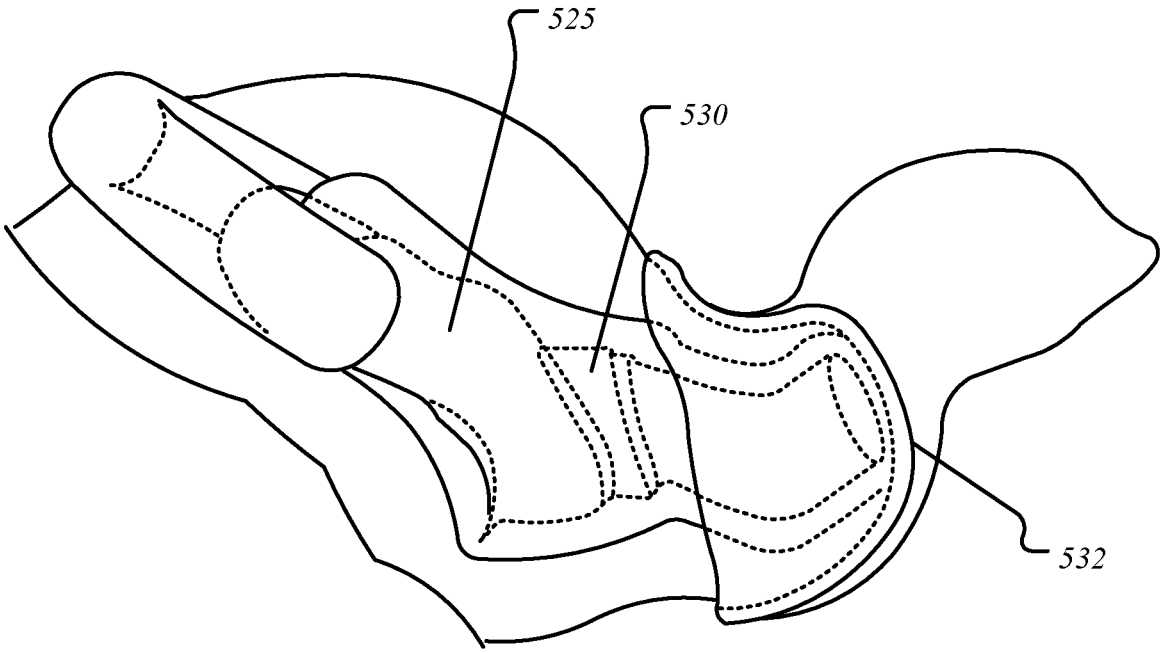

FIG. 5F illustrates the positioning of the body 525 in the electronic representation of the eartip. In some implementations, the body 525 is positioned such that contact with the tragus, anti-tragus and concha is substantially minimized. In some implementations, reducing the degree of contact in this manner can potentially reduce discomfort for the user. In some implementations, the retaining structure 527 and/or the acoustic transducer 529 may also be positioned during this step. In some cases, the acoustic transducer 529 may be positioned with respect to the body 525 such that the transducer 529 points through the aperture in the body 525 towards the first bend of the ear canal. In some implementations, an offset parameter can be used to control how far the body 525 extends into the sealing structure 517.

The outlet 530 can then be defined to extend between the body 525 and the distal end 532 of the eartip. In some implementations, the diameter of the outlet 530 is approximately 4 mm or more. The cross-section of the outlet 530 at the body end may be shaped to match the shape of the acoustic transducer or the housing thereof to be connected. The cross section of the outlet 530 at other sections can be configured in accordance with structural features of the ear canal of the user, potentially subject to one or more constraints. For example, the equivalent diameter of each section of the outlet 530 may be configured to substantially match the cross section at the body end of the outlet 530, and/or abrupt changes in the size or shape of the outlet may be avoided. In some cases, if the outlet is too small or narrow for the body end diameter to be maintained for the entire length of the outlet, the diameter of the outlet may be gradually decreased until an equivalent diameter can be maintained for the entire length of the outlet. In some implementations, the outlet may be substantially centered with respect to the exterior surface, but configured to be as straight as possible.

In some implementations, the outlet 530 may also be configured in accordance with target acoustic properties. For example, an acoustic mass of the outlet may be designed to be below a threshold value, e.g., 900 $Kg/m^4$. The acoustic mass can be decreased, for example, by increasing the cross-sectional area of the outlet, and/or shortening the outlet.

Figure 5H:
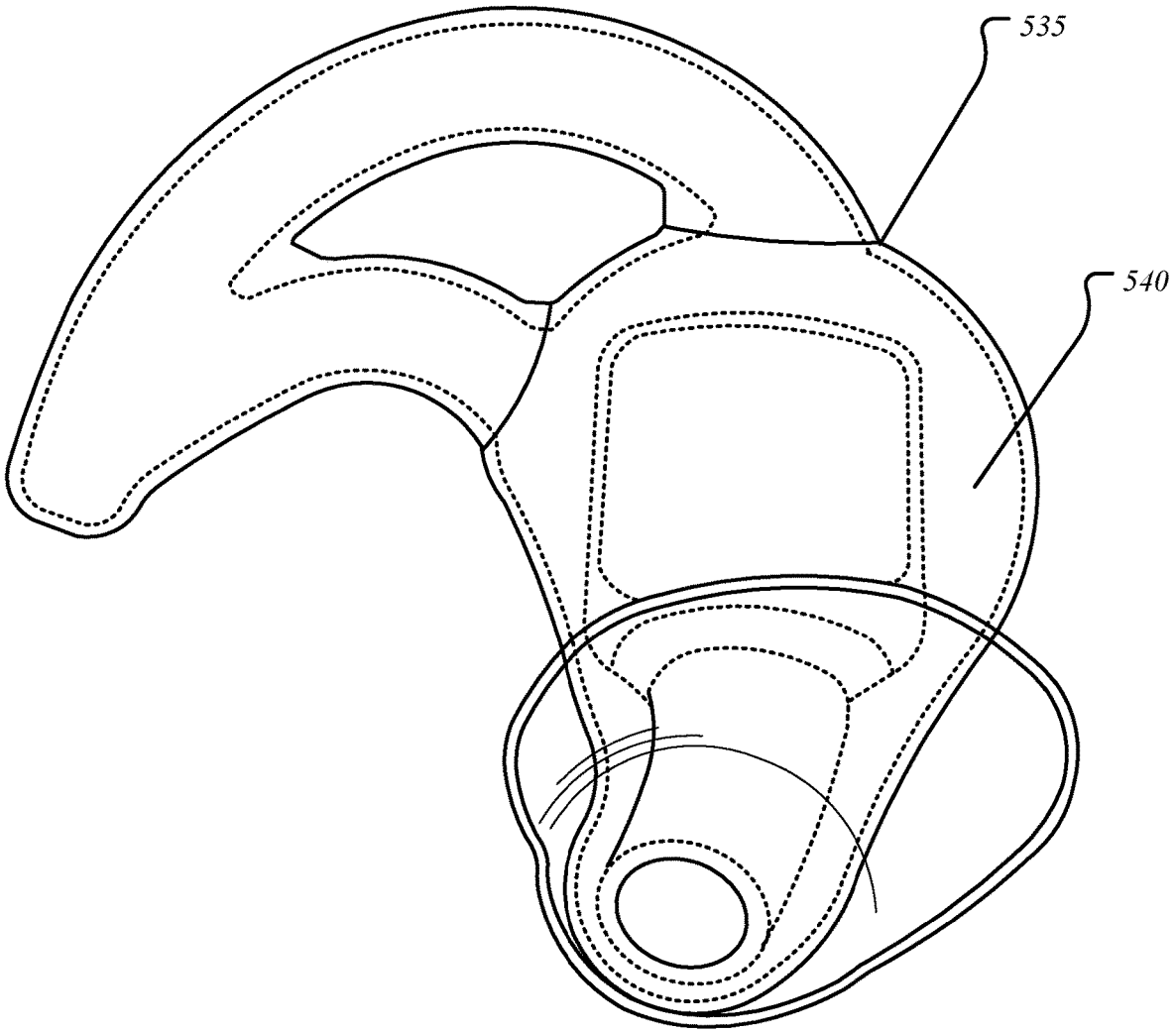

In some implementations, the electronic representation of the eartip can be configured to generate an electronic representation of a cast for the eartip. A cast generated using the latter electronic representation can be filled with the material of the earpiece (e.g., silicone) to produce the eartip. In some implementations, the thickness of the cast is between 0.40 mm and 0.50 mm. However, other values for the thickness are also possible. FIG. 5H shows the example of a cast 535 for the eartip 540.

In some implementations, one or more identifiers can be placed on the cast and/or the eartip produced using the case. Because the eartip and cast are personalized for a particular user, the identifier can be used to link the electronic representation of a cast or eartip to the particular user, and identify the physical cast/eartip during a production process.

Figure 6:
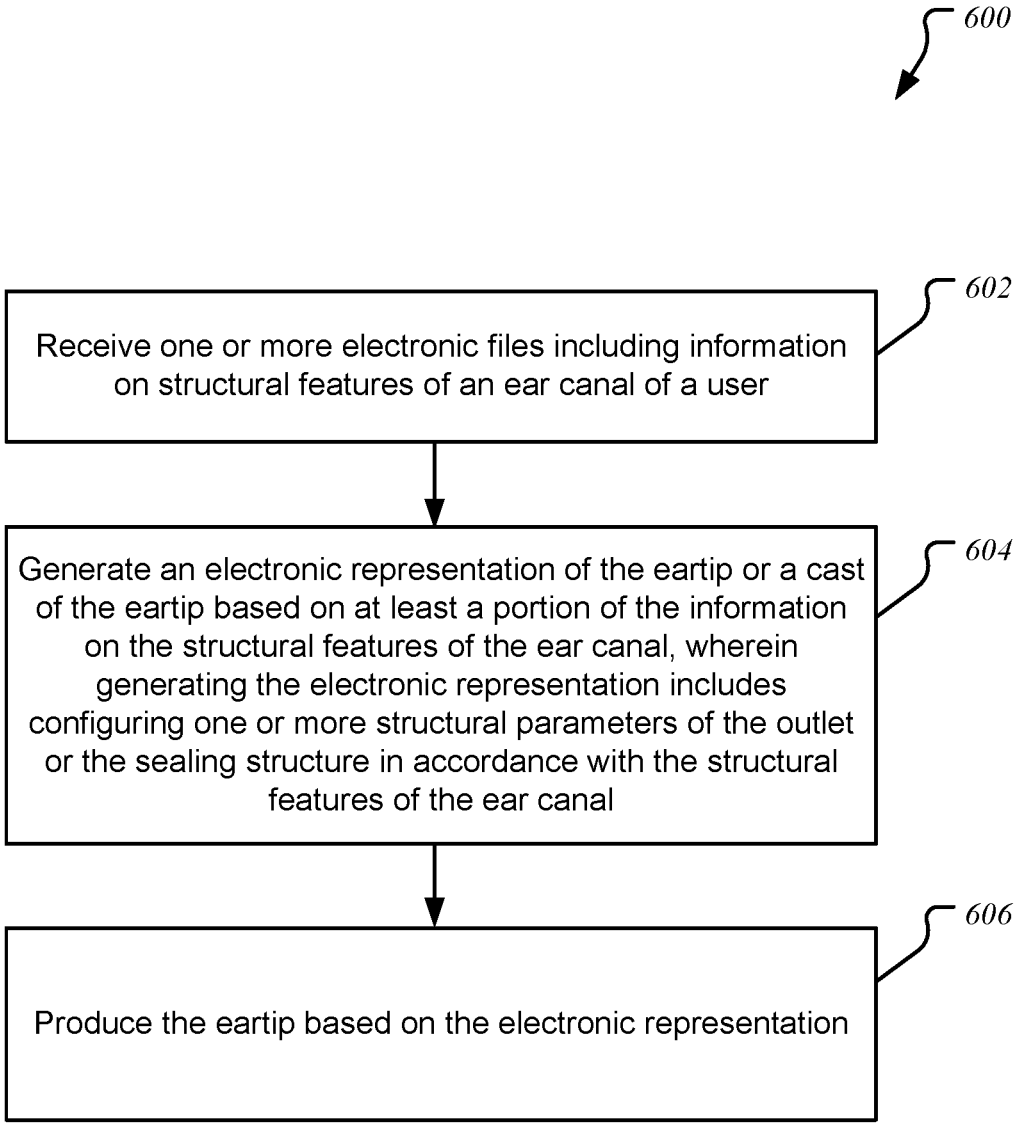
FIG. 6 is a flowchart of an example process of producing a custom-eartip.

Once the electronic representation of the eartip or cast is produced as described above, the physical eartip or cast can be produced using the electronic representation. FIG. 6 shows a flowchart of an example process 600 for producing an eartip or cast in accordance with technology described herein. At least a portion of the process 600 may be executed by one or more processing devices that may be on one device, or distributed over multiple devices connected by a network. Operations of the process 600 include receiving one or more electronic files comprising information on structural features of a concha, and/or an ear canal of a user (602). In some implementations, the one or more electronic files can be generated, at least in part, based on output of a scanning device configured to scan the concha and ear canal of the user. In some implementations, the one or more electronic files can be generated, at least in part, based on a mold of the concha and ear canal of the user. For example, such a mold of the concha and ear canal may be created manually (e.g., by a human technician) by inserting molding wax into the ear canal of the user, and the mold can then be scanned or otherwise imaged to generate the one or more electronic files. In some implementations, the one or more electronic files may be generated at a remote location and received over a network such as the Internet.

Operations of the process 600 also include generating an electronic representation of the eartip or a cast of the eartip based on at least a portion of the information on the structural features of the ear canal (604). Generating the electronic representation can include configuring one or more structural parameters of the outlet or the sealing structure in accordance with the structural features of the ear canal. The eartip can include, for example, an outlet, and a sealing structure disposed around an exterior of the outlet, as shown for example in FIGS. 4A and 4B. For example, a first end of the sealing structure can be attached to the outlet, and a second, opposite end of the sealing structure can be physically separated from the exterior of the outlet. To customize the eartip for the user, the outlet and sealing structure can be configured to comply with the structural features of the ear canal.

In some implementations, the electronic representation may be generated substantially as described above with reference to FIGS. 5A-5H. In some implementations, configuring the one or more structural parameters can include configuring a thickness of at least a portion of the sealing structure, the thickness being a distance between an interior surface and an exterior surface of the sealing structure. In some implementations, configuring the one or more structural parameters can include configuring a thickness of at least a portion of the outlet, the thickness being a distance between an interior surface and an exterior surface of the outlet. In some implementations, configuring the one or more structural parameters can include configuring a length and curvature of the outlet, and/or an orientation of the sealing structure, in accordance with the structural features of the ear canal.

In some implementations, the eartip can include a body, which may be connected to one end of the outlet, and a retaining structure, which may be connected to the body, such that when the eartip is worn by the user, the body fits in at least a part of the concha of the user's ear, and the retaining structure applies pressure to the antihelix of the user's ear. The body, outlet and retaining structure may be integrally formed, or may be formed of separate pieces. In some implementations, configuring the one or more structural parameters can include configuring a location at which the retaining structure is connected to or abuts the body, configuring a location at which the outlet is connected to or abuts the body, and/or configuring the retaining structure in accordance with structural features of the pinna of the user's ear. In some implementations, the one or more structural parameters may be configured in accordance with target acoustic characteristics of the eartip. For example, the length of the outlet and cross sectional area of at least a portion of the outlet can be configured in accordance with a target acoustic mass, as described above.

In some implementations, the electronic representation of the eartip can include a first portion of the sealing structure that is undersized with respect to a corresponding first portion of the ear canal, and a second portion that is oversized with respect to a corresponding second portion of the ear canal. Locations of the first and second portions of the sealing structure can be determined based on user-input indicative of a user's preference regarding an eartip-type. For example, the locations of the oversized and undersized portions can be determined based on whether the user prefers a "comfort" variant or a "stability" variant, as described above with reference to FIGS. 4A and 4B. In some implementations, a location of the distal end within the ear canal may also be determined based on the user-input regarding the eartip-type. For example, as described above with reference to FIGS. 4A and 4B, how deep the distal end of the eartip sits within the ear canal can be determined based on the desired variant of the eartip. While, two example variants are described above with reference to FIGS. 4A and 4B, other variants may also be possible.

Operations of the process 600 also include producing the eartip based on the electronic representation (606). This can include, for example, producing a cast based on the electronic representation, and producing the eartip using the cast. For example, a cast can be produced substantially as described above with reference to FIGS. 5A-5H, and then filled with an appropriate eartip-material (e.g., silicone) to produce the eartip. In some implementations, the cast or the eartip can be directly produced (e.g., using 3D printing) from the electronic representation.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an Field Programmable Gate Array (FPGA) and/or an application-specific integrated circuit (ASIC). In some implementations, at least a portion of the functions may also be executed on a floating point or fixed point digital signal processor (DSP) such as the Super Harvard Architecture Single-Chip Computer (SHARC) developed by Analog Devices Inc. Processing devices suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Other embodiments and applications not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

What is claimed is:

1. A method of producing an eartip, the method comprising:

receiving one or more electronic files comprising information on structural features of a portion of an ear of a user;

receiving user-input indicative of an eartip-type, the eartip-type corresponding to a depth of insertion of the eartip, generating, by one or more processing devices, an electronic representation of the eartip or a cast of the eartip based on at least a portion of the information on the structural features of the portion of the ear; and producing the eartip based on the electronic representation, such that the eartip comprises (i) an outlet, (ii) a sealing structure disposed around an exterior of the outlet, wherein a first end of the sealing structure is attached to the outlet, and a second, opposite end of the sealing structure is physically separated from the exterior of the outlet, (iii) a body connected to the outlet, and (iv) a retaining structure connected to the body, such that when the eartip is worn by the user, the body fits in at least a part of the concha of the user's ear, and the retaining structure applies pressure to the antihelix of the user's ear, wherein generating the electronic representation comprises configuring one or more structural parameters of the outlet or the sealing structure in accordance with the structural features of the portion of the ear, and configuring the one or more structural parameters of the sealing structure comprises oversizing a body end portion of the sealing structure based on the user-input to achieve the depth of insertion of the eartip.

2. The method of claim 1, wherein configuring the one or more structural parameters comprises configuring a thickness of at least a portion of the sealing structure, the thickness being a distance between an interior surface and an exterior surface of the sealing structure.

3. The method of claim 1, wherein configuring the one or more structural parameters comprises configuring a thickness of at least a portion of the outlet, the thickness being a distance between an interior surface and an exterior surface of the outlet.

4. The method of claim 1, wherein configuring the one or more structural parameters comprises configuring a length and curvature of the outlet in accordance with the structural features of the portion of the ear.

5. The method of claim 1, wherein configuring the one or more structural parameters comprises configuring an orientation of the sealing structure in accordance with the structural features of the portion of the ear.

6. The method of claim 1, wherein the one or more electronic files comprise information on structural features of an antihelix of a user, and configuring the one or more structural parameters comprises configuring a location at which the retaining structure is connected to the body.

7. The method of claim 1, wherein configuring the one or more structural parameters comprises configuring a location at which the outlet is connected to the body.

8. The method of claim 1, further comprising configuring the retaining structure in accordance with structural features of the pinna of the user's ear.

9. The method of claim 1, wherein the one or more electronic files are generated, at least in part, based on a mold of the portion of the ear of the user.

10. The method of claim 1, wherein the electronic representation of the eartip comprises a first portion of the sealing structure that is undersized with respect to a corresponding first portion of an ear canal, and a second portion of the sealing structure that is oversized with respect to a corresponding second portion of the ear canal.

11. The method of claim 10, further comprising:

responsive to receiving the user-input indicative of the eartip-type, determining the location of at least one of the first portion and the second portion of the sealing structure with respect to the structural features of the ear canal.

12. The method of claim 1, further comprising:

responsive to receiving the user-input indicative of the eartip type, determining the location of a distal end of the outlet with respect to the structural features of the portion of the ear.

13. The method of claim 1, wherein producing the eartip based on the electronic representation comprises:

producing a cast based on the electronic representation; and producing the eartip using the cast.

14. The method of claim 1, wherein the one or more structural parameters comprises the length of the outlet and cross sectional area of at least a portion of the outlet, and at least one of the length and the cross sectional area is configured based on target acoustic characteristics of the eartip.

15. The method of claim 14, wherein the target acoustic characteristics comprise an acoustic mass below 900 $Kg/m^4$.

16. One or more non-transitory machine-readable storage devices having encoded thereon computer readable instructions for causing one or more processing devices to perform operations comprising:

receiving one or more electronic files comprising information on structural features of a portion of an ear of a user;

receiving user-input indicative of an eartip-type, the eartip-type corresponding to the user's preferences for a depth of insertion of the eartip; and generating an electronic representation of an eartip or a cast for the eartip based on at least a portion of the information on the structural features of the portion of the ear, wherein the eartip comprises (i) an outlet, (ii) a sealing structure disposed around an exterior of the outlet, wherein a first end of the sealing structure is attached to the outlet, and a second, opposite end of the sealing structure is physically separated from the exterior of the outlet (iii) a body connected to the outlet, and (iv) a retaining structure connected to the body, such that when the eartip is worn by the user, the body fits in at least a part of the concha of the user's ear, and the retaining structure applies pressure to the antihelix of the user's ear, wherein generating the electronic representation comprises configuring one or more structural parameters of the outlet or the sealing structure in accordance with the structural features of the portion of the ear, and configuring the one or more structural parameters of the sealing structure comprises oversizing a body end portion of the sealing structure based on the user-input to achieve the depth of insertion of the eartip.

17. The one or more non-transitory machine-readable storage devices of claim 16, wherein configuring the one or more structural parameters comprises configuring a thickness of at least a portion of the sealing structure, the thickness being a distance between an interior surface and an exterior surface of the sealing structure.

18. The one or more non-transitory machine-readable storage devices of claim 16, wherein configuring the one or more structural parameters comprises configuring a thickness of at least a portion of the outlet, the thickness being a distance between an interior surface and an exterior surface of the outlet.

19. The one or more non-transitory machine-readable storage devices of claim 16, wherein configuring the one or more structural parameters comprises configuring a length and curvature of the outlet in accordance with the structural features of the portion of the ear.

20. The one or more non-transitory machine-readable storage devices of claim 16, wherein configuring the one or more structural parameters comprises configuring an orientation of the sealing structure in accordance with the structural features of the portion of the ear.

21. The one or more non-transitory machine-readable storage devices of claim 16, wherein the electronic representation of the eartip comprises a first portion of the sealing structure that is undersized with respect to a corresponding first portion of an ear canal, and a second portion of the sealing structure that is oversized with respect to a corresponding second portion of the ear canal.

22. The one or more non-transitory machine-readable storage devices of claim 16, wherein the one or more structural parameters comprise the length of the outlet and cross sectional area of at least a portion of the outlet, and at least one of the length and the cross sectional area is configured such that an acoustic mass of the eartip is less than 900 $Kg/m^4$.

23. The method of claim 1, wherein the one or more electronic files are generated, at least in part, based on output of a scanning device configured to scan a shape corresponding to the portion of the ear.

24. The method of claim 23, wherein the shape scanned by the scanning device comprises at least one of a concha of the user and an ear canal of the user.

25. The method of claim 23, wherein the shape scanned by the scanning device comprises a mold of at least one of a concha of the user and an ear canal of the user.

* * * * *